US012571120B2

(12) United States Patent
Hamada et al.

(10) Patent No.: US 12,571,120 B2
(45) Date of Patent: Mar. 10, 2026

(54) PLATING APPARATUS

(71) Applicant: Tokyo Electron Limited, Tokyo (JP)

(72) Inventors: Masato Hamada, Kumamoto (JP); Masami Akimoto, Koshi (JP); Masatoshi Shiraishi, Kumamoto (JP); Kazuyuki Goto, Koshi (JP); Satoshi Kaneko, Koshi (JP); Kazuki Motomatsu, Koshi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 804 days.

(21) Appl. No.: 17/908,660

(22) PCT Filed: Feb. 17, 2021

(86) PCT No.: PCT/JP2021/005928
§ 371 (c)(1),
(2) Date: Sep. 1, 2022

(87) PCT Pub. No.: WO2021/177035
PCT Pub. Date: Sep. 10, 2021

(65) Prior Publication Data

US 2023/0096305 A1 Mar. 30, 2023

(30) Foreign Application Priority Data

Mar. 2, 2020 (JP) ..... 2020-034613

(51) Int. Cl.
*C25D 5/08* (2006.01)
*C25D 7/12* (2006.01)
(Continued)

(52) U.S. Cl.
CPC ..... *C25D 5/08* (2013.01); *C25D 7/123* (2013.01); *C25D 17/001* (2013.01); *C25D 17/10* (2013.01); *C25D 21/08* (2013.01)

(58) Field of Classification Search
CPC ..... C25D 7/12–123; C25D 17/001; H01L 21/20085; H01L 21/76873; H01L 2224/11462
See application file for complete search history.

(56) References Cited

U.S. PATENT DOCUMENTS 6,280,581 B1 8/2001 Cheng
6,495,005 B1 * 12/2002 Colgan ..... H10D 86/0241 204/196.15
(Continued)

FOREIGN PATENT DOCUMENTS

JP S57-09894 A 1/1982
JP 2005-133160 A 5/2005
(Continued)

OTHER PUBLICATIONS

International Search Report for PCT/JP2021/005928 dated Apr. 27, 2021.

*Primary Examiner* — Hosung Chung
(74) *Attorney, Agent, or Firm* — Chrisman Gallo Tochtrop LLC

(57) ABSTRACT

A plating apparatus 1 includes a substrate holder 10, a first electrode, a second electrode and a voltage applying unit 30. The substrate holder 10 is configured to hold a substrate. The first electrode is electrically connected to the substrate. The second electrode is configured to scan with respect to a front surface of the substrate. The voltage applying unit 30 is configured to apply a voltage between the first electrode and the second electrode. A first discharge opening 23 configured to discharge a plating liquid L1 and a second discharge opening 24 configured to discharge a cleaning liquid L2 are formed in a bottom surface 22*a* of the second electrode.

6 Claims, 6 Drawing Sheets

(51) Int. Cl.

| | |
|---|---|
| ***C25D 17/00*** | (2006.01) |
| ***C25D 17/10*** | (2006.01) |
| ***C25D 21/08*** | (2006.01) |

(56) References Cited

U.S. PATENT DOCUMENTS

| | | | | |
|---|---|---|---|---|
| 2004/0178060 | A1* | 9/2004 | Ravkin | C25D 7/123<br>204/232 |
| 2005/0083048 | A1* | 4/2005 | Lei | H01L 21/67253<br>216/37 |
| 2005/0217703 | A1* | 10/2005 | O'Donnell | H01L 21/6704<br>134/21 |

FOREIGN PATENT DOCUMENTS

| | | | |
|---|---|---|---|
| JP | 2006-049858 | A | 2/2006 |
| JP | 2007-521391 | A | 8/2007 |
| JP | 2007-525595 | A | 9/2007 |
| WO | 2005/005692 | A1 | 1/2005 |
| WO | 2005/076977 | A2 | 8/2005 |
| WO | 2019/102866 | A1 | 5/2019 |
| WO | 2019/151078 | A1 | 8/2019 |

* cited by examiner

PLATING APPARATUS

CROSS-REFERENCE TO RELATED APPLICATIONS

This Application is a U.S. national phase application under 35 U.S.C. § 371 of PCT Application No. PCT/JP2021/005928 filed on Feb. 17, 2021, which claims the benefit of Japanese Patent Application No. 2020-034613 filed on Mar. 2, 2020, the entire disclosures of which are incorporated herein by reference.

TECHNICAL FIELD

The various aspects and embodiments described herein pertain generally to a plating apparatus.

BACKGROUND

Conventionally, there is known a method of forming a plating film on a surface of a semiconductor wafer (hereinafter, simply referred to as a wafer) as a substrate by performing a plating processing while holding the wafer with a spin chuck (see, for example, Patent Document 1).

Patent Document 1: Japanese Patent Laid-open Publication No. 2005-133160

SUMMARY

In one exemplary embodiment, a plating apparatus includes a substrate holder, a first electrode, a second electrode and a voltage applying unit. The substrate holder is configured to hold a substrate. The first electrode is electrically connected to the substrate. The second electrode is configured to scan with respect to a front surface of the substrate. The voltage applying unit is configured to apply a voltage between the first electrode and the second electrode. A first discharge opening configured to discharge a plating liquid and a second discharge opening configured to discharge a cleaning liquid are formed in a bottom surface of the second electrode.

DETAILED DESCRIPTION

Hereinafter, exemplary embodiments of a plating apparatus according to the present disclosure will be described in detail with reference to the accompanying drawings. The present disclosure is not limited to the exemplary embodiments to be described below. Further, it should be noted that the drawings are schematic and relations in sizes of individual components and ratios of the individual components may sometimes be different from actual values. Even between the drawings, there may exist parts having different dimensional relationships or different ratios.

Conventionally, there is known a method of forming a plating film on a surface of a semiconductor wafer (hereinafter, simply referred to as a wafer) as a substrate by performing a plating processing while holding the wafer with a spin chuck.

In the prior art, however, since the plating processing is performed by using an anode electrode having the same size as the wafer, it is difficult to form the plating film uniformly on the entire surface of the wafer.

Therefore, there is a demand for a technique capable of overcoming the aforementioned problem, thus enabling to form the plating film having high in-surface uniformity on the entire surface of the wafer.

<Plating Apparatus>

Figure 1:
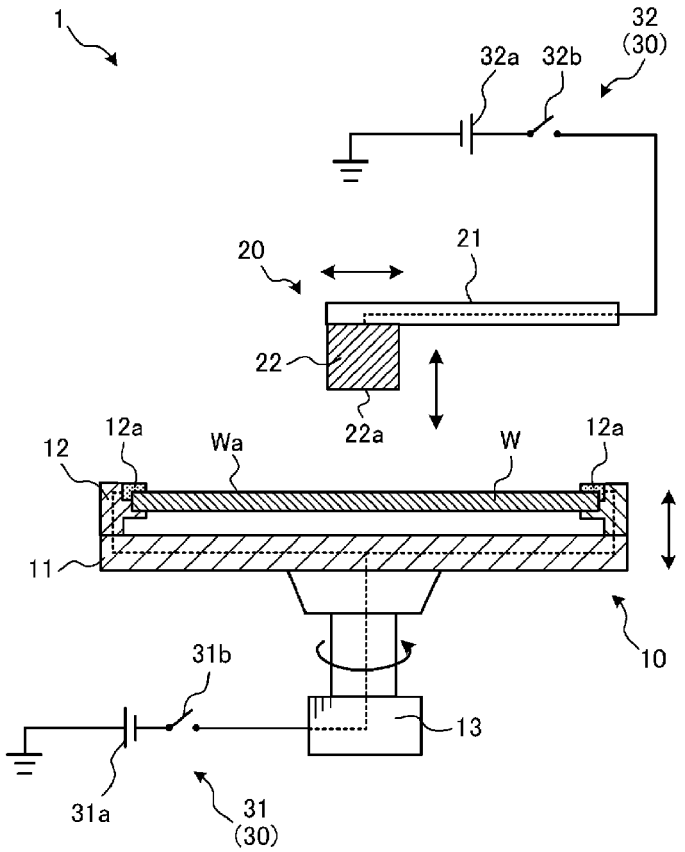
FIG. 1 is a diagram illustrating a schematic configuration of a plating apparatus according to an exemplary embodiment.

First, referring to FIG. 1, an outline of a plating apparatus 1 according to an exemplary embodiment will be explained. FIG. 1 is a diagram illustrating a schematic configuration of the plating apparatus 1 according to the exemplary embodiment.

In this plating apparatus 1, a plating processing is performed on a semiconductor wafer W (hereinafter, referred to as "wafer W") as a processing target substrate. The plating apparatus 1 includes a substrate holder 10, a plating unit 20, and a voltage applying unit 30.

The substrate holder 10 holds the wafer W horizontally. The substrate holder 10 includes a base 11, a holding member 12, and a driving mechanism 13. The base 11 is, for example, a spin chuck configured to hold and rotate the wafer W. The base 11 is of a substantially disk shape, and has a diameter larger than that of the wafer W when viewed from the top.

The holding member 12 is provided on a top surface of the base 11, and is configured to hold the wafer W from the side. The wafer W is horizontally held by this holding member 12 while being slightly spaced apart from the top surface of the base 11. Further, the wafer W is held by the substrate holder 10 with its front surface Wa to be subjected to a substrate processing facing upwards.

In addition, the holding member 12 is provided with a cathode electrode 12*a*. The cathode electrode 12*a* is an example of a first electrode. When the wafer W is held by the holding member 12, this cathode electrode 12*a* comes into contact with a seed layer (not shown) formed on the front surface Wa of the wafer W.

Further, the cathode electrode 12*a* is connected to the voltage applying unit 30 to be described later so that a predetermined voltage can be applied to the seed layer of the wafer W which is in contact with the cathode electrode 12*a*.

The substrate holder 10 is further equipped with the driving mechanism 13 having a motor or the like, and is thus capable of rotating the base 11 at a preset speed. Further, the driving mechanism 13 is provided with an elevational driving unit (not shown) such as a cylinder, and is thus capable of moving the base 11 in a vertical direction.

Above the substrate holder 10 described so far, the plating unit 20 is provided so as to face the top surface of the base 11. The plating unit 20 includes an arm 21 and an anode electrode 22. The anode electrode 22 is an example of a second electrode.

The arm 21 is made of a rod-shaped insulating material or the like. The anode electrode 22 is made of a conductive material, and is provided on a bottom surface of a leading end portion of the arm 21. A bottom surface 22*a* of this anode electrode 22 is disposed so as to face the wafer W held by the substrate holder 10 substantially in parallel thereto.

When a plating processing is performed, the bottom surface 22*a* of the anode electrode 22 is in direct contact with a plating liquid L1 (see FIG. 2) supplied on the wafer W. Further, the anode electrode 22 is connected to the voltage applying unit 30 to be described later so that a predetermined voltage can be applied to the plating liquid L1 in contact with the anode electrode 22. A detailed configuration of the anode electrode 22 will be described later.

A non-illustrated moving mechanism is provided at a base end of the arm 21. This moving mechanism has, for example, an elevational driving unit such as a cylinder, and a rotational driving unit such as a motor. By using the elevational driving unit and the rotational driving unit, the arm 21 is capable of operating the anode electrode 22 to scan with respect to the front surface Wa of the wafer W.

In addition, although the arm 21 is used as a member that supports the anode electrode 22 in the example of FIG. 1, the member that supports the anode electrode 22 is not limited to the arm.

The voltage applying unit 30 is configured to apply a predetermined voltage between the cathode electrode 12*a* of the holding member 12 and the anode electrode 22. The voltage applying unit 30 includes, by way of example, a negative voltage applying unit 31 and a positive voltage applying unit 32.

The negative voltage applying unit 31 is configured to apply a negative voltage to the cathode electrode 12*a* of the holding member 12. The negative voltage applying unit 31 has a DC power supply 31*a* and a switch 31*b*, and is connected to the cathode electrode 12*a* of the holding member 12. Specifically, a negative pole of the DC power supply 31*a* is connected to the cathode electrode 12*a* of the holding member 12 via the switch 31*b*, and a positive pole of the DC power supply 31*a* is grounded.

By turning the switch 31*b* into an on state, the negative voltage applying unit 31 is capable of applying a predetermined negative voltage to the cathode electrode 12*a* of the holding member 12.

The positive voltage applying unit 32 is configured to apply a positive voltage to the anode electrode 22. The positive voltage applying unit 32 has a DC power supply 32*a* and a switch 32*b*, and is connected to the anode electrode 22. Specifically, a positive pole of the DC power supply 32*a* is connected to the anode electrode 22 via the switch 32*b*, and a negative pole of the DC power supply 32*a* is grounded.

By turning the switch 32*b* into an on state, the positive voltage applying unit 32 is capable of applying a predetermined positive voltage to the anode electrode 22.

In addition, the configuration of the voltage applying unit 30 is not limited to the example of FIG. 1, and the voltage applying unit 30 may have any configuration as long as the predetermined voltage can be applied between the cathode electrode 12*a* of the holding member 12 and the anode electrode 22.

A control device (not shown) configured to control the plating apparatus 1 is, for example, a computer, and includes a controller (not shown) and a storage (not shown). The controller includes a microcomputer having a central processing unit (CPU), a read only memory (ROM), a random access memory (RAM), input/output ports, and so forth, and various kinds of circuits.

The CPU of this microcomputer reads out and executes a program stored in the ROM, thus carrying out a control over the various components of the plating apparatus 1 such as the substrate holder 10, the plating unit 20, and the voltage applying unit 30.

In addition, such a program may be recorded on a computer-readable recording medium, and may be installed from this recording medium into the storage of the control device. Examples of the computer-readable recording medium may include a hard disk (HD), a flexible disk (FD), a compact disk (CD), a magnet optical disk (MO), a memory card, and so forth.

The storage is implemented by, for example, a semiconductor memory device such as a RAM or a flash memory, or a storage device such as a hard disk or an optical disk.

<Anode Electrode>

Figure 2:
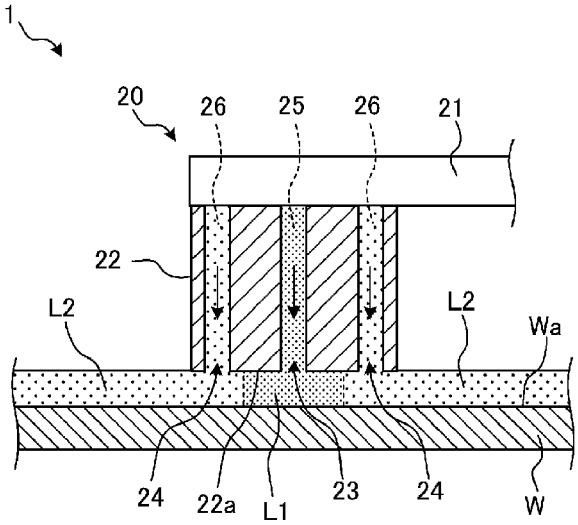
FIG. 2 is a diagram illustrating a configuration of an anode electrode of the plating apparatus according to the exemplary embodiment.
Figure 3:
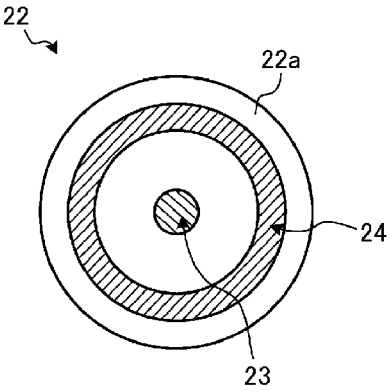
FIG. 3 is a diagram illustrating a configuration of a bottom surface of the anode electrode according to the exemplary embodiment.

Now, referring to FIG. 2 and FIG. 3, the anode electrode 22 of the plating apparatus 1 according to the exemplary embodiment will be elaborated. FIG. 2 is a diagram illustrating the configuration of the anode electrode 22 of the plating apparatus 1 according to the exemplary embodiment, and FIG. 3 is a diagram illustrating a configuration of the bottom surface 22*a* of the anode electrode 22 according to the exemplary embodiment.

As depicted in FIG. 2, the bottom surface 22*a* of the anode electrode 22 according to the exemplary embodiment is provided with a first discharge opening 23 and a second discharge opening 24. Further, in the exemplary embodiment, the bottom surface 22*a* of the anode electrode 22 is substantially flat.

Through a first supply path 25, the first discharge opening 23 communicates with a plating liquid source (not shown) that stores the plating liquid L1 therein. The first discharge opening 23 discharges the plating liquid L1 supplied from the plating liquid source through the first supply path 25 to the front surface Wa of the wafer W.

For example, when a Cu film is formed as the plating film, the plating liquid L1 may contain copper ions and sulfate ions.

Through a second supply path 26, the second discharge opening 24 communicates with a cleaning liquid source (not shown) that stores a cleaning liquid L2 therein. The second discharge opening 24 discharges the cleaning liquid L2 supplied from the cleaning liquid source through the second supply path 26 to the front surface Wa of the wafer W. The cleaning liquid L2 is, for example, pure water.

For example, as shown in FIG. 3, the first discharge opening 23 is provided in a central portion of the bottom surface 22*a* of the circular anode electrode 22, and the second discharge opening 24 is provided at an outer side than the first discharge opening 23 in the bottom surface 22*a* of the anode electrode 22. By way of example, the second discharge opening 24 is provided in an annular shape so as to surround the first discharge opening 23 in the bottom surface 22*a* of the anode electrode 22.

A plating processing using the anode electrode 22 according to the exemplary embodiment will be described with reference to FIG. 2. First, in the plating apparatus 1 according to the exemplary embodiment, the wafer W is transferred to the substrate holder 10 (see FIG. 1) by using a non-illustrated transfer mechanism. Then, the controller operates the holding member 12 (see FIG. 1), thus allowing the wafer W to be held by the substrate holder 10.

Next, the controller operates the arm 21 to bring the anode electrode 22 close to the wafer W. At this time, the controller controls the anode electrode 22 to approach the wafer W so that a distance between the front surface Wa of the wafer W and the bottom surface 22*a* of the anode electrode 22 becomes a preset distance (for example, about 100 μm).

Then, the controller discharges the plating liquid L1 from the first discharge opening 23 into a gap between the wafer W and the anode electrode 22 while rotating the wafer W at a predetermined rotation speed R1 (for example, 2 rpm to 10 rpm) by using the driving mechanism 13 (see FIG. 1).

In parallel with this discharging process of the plating liquid L1, the controller discharges the cleaning liquid L2 from the second discharge opening 24 into the gap between the wafer W and the anode electrode 22. Accordingly, in the exemplary embodiment, a region in which the plating liquid L1 locally exists around the first discharge opening 23 can be formed, as shown in FIG. 2.

Thereafter, the controller turns the switches 31*b* and 32*b* (see FIG. 1) of the voltage applying unit 30 into an on state from an off state while rotating the wafer W at the predetermined rotation speed R1 by using the driving mechanism 13 (see FIG. 1).

Accordingly, the negative potential is applied to the cathode electrode 12*a* of the holding member 12, and the positive voltage is applied to the anode electrode 22. As described above, by this voltage applying process, the voltage applying unit 30 applies the predetermined voltage between the wafer W and the anode electrode 22.

As a result, an electric field is formed inside the plating liquid L1 that locally exists around the first discharge opening 23, and as copper ions, which are positively charged particles, are accumulated on the front surface Wa side of the wafer W, a plating film is locally formed on the front surface Wa of the wafer W.

In addition, in the exemplary embodiment, since a processing liquid mainly including the cleaning liquid L2 exists on the front surface Wa other than the region where the plating liquid L1 locally exists, the plating film is hardly formed there even if the voltage is applied between the wafer W and the anode electrode 22.

Then, while scanning the anode electrode 22 with respect to the front surface Wa of the wafer W, the controller performs the above-described plating liquid discharging process, the cleaning liquid discharging process, and the voltage applying process repeatedly. Accordingly, in the plating apparatus 1 according to the exemplary embodiment, it is possible to perform the plating processing on the entire surface of the wafer W.

As described so far, in the exemplary embodiment, while performing the plating processing only on the region under the anode electrode 22, the anode electrode 22 is scanned with respect to the front surface Wa of the wafer W. Accordingly, it is possible to perform the plating processing while appropriately adjusting the film thickness of the plating film in each region of the wafer W.

Therefore, according to the exemplary embodiment, it is possible to form the plating film having high in-surface uniformity on the entire surface of the wafer W.

In addition, in the exemplary embodiment, since the second discharge opening 24 configured to discharge the cleaning liquid L2 is provided at the outer side than the first discharge opening 23 configured to discharge the plating liquid L1, the amount of the plating liquid L1 present at locations other than the region under the anode electrode 22 can be reduced.

That is, in the exemplary embodiment, it is possible to suppress dissolution of the seed layer by the plating liquid L1 and abnormal precipitation of components included in the plating liquid L1 at locations other than the target region of the plating processing. Therefore, according to the exemplary embodiment, the plating processing can be carried out stably.

In addition, in the exemplary embodiment, since the second discharge opening 24 is provided so as to surround the first discharge opening 23, the plating processing can be performed with little or no plating liquid L1 present at the locations other than the region under the anode electrode 22.

That is, in the exemplary embodiment, it is possible to further suppress the dissolution of the seed layer by the plating liquid L1 and the abnormal precipitation of the components contained in the plating liquid L1 at the locations other than the target region of the plating processing. Therefore, according to the exemplary embodiment, the plating processing can be carried out more stably.

Furthermore, in the exemplary embodiment, it may be desirable to bring the anode electrode 22 close to the wafer W so that the gap between the front surface Wa of the wafer W and the bottom surface 22*a* of the anode electrode 22 becomes a narrow gap of about 100 μm.

With this configuration, the amount of the plating liquid L1 used can be reduced, and the resistance of the plating liquid L1 generated when the anode electrode 22 is scanned can also be reduced.

In the plating processing according to the exemplary embodiment, after the plating film is formed on the entire surface of the wafer W, a substrate cleaning process is performed. For example, the controller operates the arm to move the anode electrode 22 to above the central portion of the wafer W held by the substrate holder 10.

Then, the controller discharges the cleaning liquid L2 from the second discharge opening 24 to the central portion of the wafer W while rotating the wafer W at a preset rotation speed R2 (e.g., 500 rpm or higher) by using the driving mechanism 13. Then, if the controller stops the discharge of the cleaning liquid L2 from the second discharge opening 24, the substrate cleaning process is ended.

Through this substrate cleaning process, the plating liquid L1 or the like supplied on the wafer W is washed away, so that the front surface Wa of the wafer W is cleaned. In this way, the plating processing according to the exemplary embodiment is completed.

<Various Modification Examples>

Now, various modification examples of the exemplary embodiment will be explained with reference to FIG. 4 to FIG. 10. In the various modification examples to be described below, parts identical to those of the exemplary embodiment will be assigned same reference numerals, and redundant description thereof will be omitted.

Figure 4:
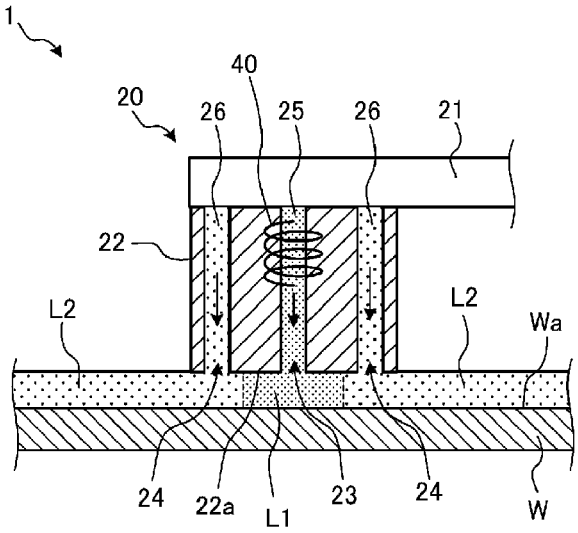
FIG. 4 is a diagram illustrating a configuration of an anode electrode of the plating apparatus according to a first modification example of the exemplary embodiment.

FIG. 4 is a diagram showing a configuration of an anode electrode 22 of the plating apparatus 1 according to a first modification example of the exemplary embodiment. As shown in FIG. 4, the first modification example is different from the exemplary embodiment in that the plating unit 20 is additionally provided with a coil 40.

The coil 40 is provided near the first supply path 25 configured to discharge the plating liquid L1 to the first discharge opening 23 to generate a magnetic field in the plating liquid L1 flowing through the first supply path 25.

Accordingly, in the first modification example, metal ions configured to form the plating film can be diffused in the plating liquid L1 discharged from the first discharge opening 23. Therefore, according to the first modification example, the uniform plating film can be formed.

Figure 5:
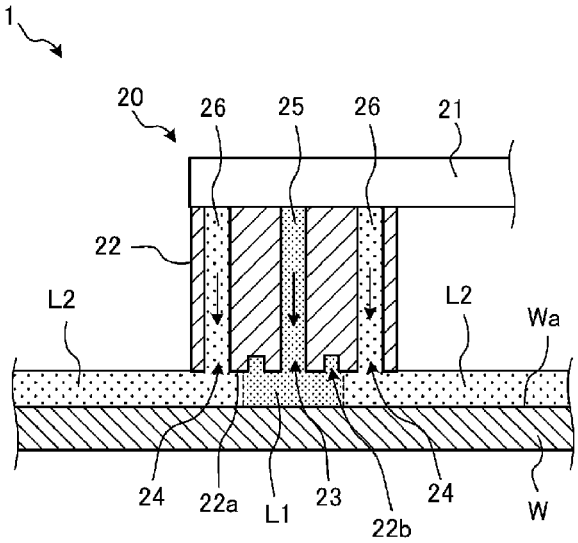
FIG. 5 is a diagram illustrating a configuration of an anode electrode of the plating apparatus according to a second modification example of the exemplary embodiment.

FIG. 5 is a diagram showing a configuration of an anode electrode 22 of the plating apparatus 1 according to a second modification example of the exemplary embodiment. As illustrated in FIG. 5, in the second modification example, the shape of the bottom surface 22*a* of the anode electrode 22 is different from that of the exemplary embodiment. To elaborate, in the second modification example, the bottom surface 22*a* of the anode electrode 22 is provided with a plurality of recesses 22*b*.

Accordingly, when the plating processing is performed while scanning the anode electrode 22 with respect to the front surface Wa of the wafer W, the plating liquid L1 can be agitated in the plurality of recesses 22*b*. Therefore, according to the second modification example, the metal ions configured to form the plating film can be diffused in the plating liquid L1, so that the uniform plating film can be formed.

Figure 6:
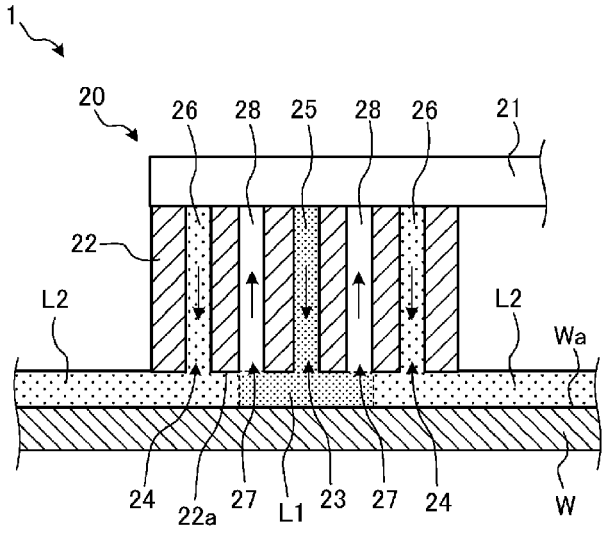
FIG. 6 is a diagram illustrating a configuration of an anode electrode of the plating apparatus according to a third modification example of the exemplary embodiment.
Figure 7:
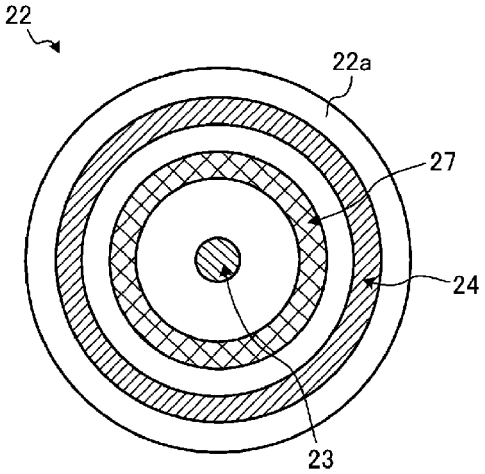
FIG. 7 is a diagram illustrating a configuration of a bottom surface of the anode electrode according to the third modification example of the exemplary embodiment.

FIG. 6 is a diagram illustrating a configuration of an anode electrode 22 of the plating apparatus 1 according to a third modification example of the exemplary embodiment, and FIG. 7 is a diagram showing a configuration of the bottom surface 22*a* of the anode electrode 22 according to the third modification example of the exemplary embodiment.

As shown in FIG. 6, in the third modification example, the bottom surface 22*a* of the anode electrode 22 is further provided with a suction opening 27. The suction opening 27 is connected to a non-illustrated suction mechanism via a suction path 28. By operating this suction mechanism, the anode electrode 22 of the third modification example can suck in the processing liquid or the like from the suction opening 27.

For example, as shown in FIG. 7, the first discharge opening 23 is provided in the central portion of the bottom surface 22*a* of the circular anode electrode 22, and the suction opening 27 is provided at an outer side than the first discharge opening 23 in the bottom surface 22*a* of the anode electrode 22. For example, the suction opening 27 is provided in an annular shape so as to surround the first discharge opening 23 in the bottom surface 22*a* of the anode electrode 22.

Further, the second discharge opening 24 is provided at an outer side than the suction opening 27 in the bottom surface 22*a* of the anode electrode 22. By way of example, the second discharge opening 24 is provided in the bottom surface 22*a* of the anode electrode 22 so as to surround the suction opening 27 concentrically.

In the third modification example, when the plating liquid L1 and the cleaning liquid L2 are supplied into the gap between the wafer W and the anode electrode 22, the suction mechanism is operated to suck the plating liquid L1 and the cleaning liquid L2 present between the first discharge opening 23 and the second discharge opening 24 through the suction opening 27.

Accordingly, the amount of the plating liquid L1 present at the locations other than the region under the anode electrode 22 can be further reduced. That is, in the third modification example, it is possible to further suppress the dissolution of the seed layer by the plating liquid L1 and the abnormal precipitation of the components included in the plating liquid L1 at the locations other than the target region of the plating processing.

Therefore, according to the third modification example, the plating processing can be performed more stably.

Further, in the third modification example, since the cleaning liquid L2 present between the first discharge opening 23 and the second discharge opening 24 can be sucked, it is possible to suppress a decrease in the concentration of the plating liquid L1 that may be caused as the cleaning liquid L2 is mixed into the plating liquid L1 which locally exists under the anode electrode 22.

Therefore, according to the third modification example, the plating processing can be carried out more stably.

Figure 8:
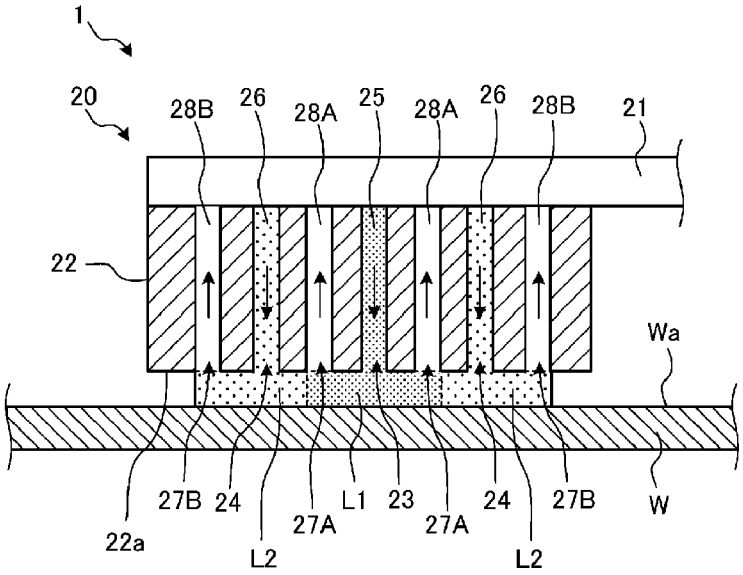
FIG. 8 is a diagram illustrating a configuration of an anode electrode of the plating apparatus according to a fourth modification example of the exemplary embodiment.
Figure 9:
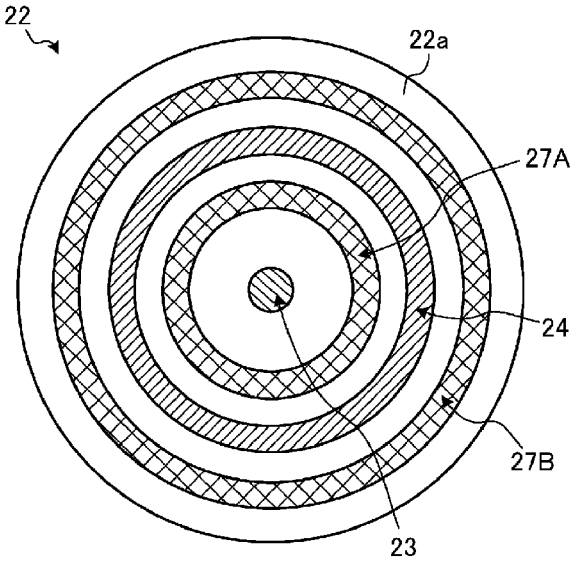
FIG. 9 is a diagram illustrating a configuration of a bottom surface of the anode electrode according to the fourth modification example of the exemplary embodiment.

FIG. 8 is a diagram illustrating a configuration of an anode electrode 22 of the plating apparatus 1 according to a fourth modification example of the exemplary embodiment, and FIG. 9 is a diagram illustrating a configuration of the bottom surface 22*a* of the anode electrode 22 according to the fourth modification example of the exemplary embodiment.

As depicted in FIG. 8, in the fourth modification example, the bottom surface 22*a* of the anode electrode 22 is provided with a plurality of suction openings 27A and 27B. The suction opening 27A is connected to a non-illustrated suction mechanism via a suction path 28A.

The suction opening 27B is connected to the non-illustrated suction mechanism via the suction path 28B. By operating this suction mechanism, the anode electrode 22 of the fourth modification example can suck in the processing liquid or the like from the suction openings 27A and 27B.

For example, as illustrated in FIG. 9, the first discharge opening 23 is provided in the central portion of the bottom surface 22*a* of the circular anode electrode 22, and the suction opening 27A is provided at an outer side than the first discharge opening 23 in the bottom surface 22*a* of the anode electrode 22. By way of example, the suction opening 27A is provided in an annular shape so as to surround the first discharge opening 23 in the bottom surface 22*a* of the anode electrode 22.

Further, the second discharge opening 24 is provided at an outer side than the suction opening 27A in the bottom surface 22*a* of the anode electrode 22. For example, the second discharge opening 24 is provided in the bottom surface 22*a* of the anode electrode 22 so as to surround the suction opening 27A concentrically.

In addition, the suction opening 27B is provided at an outer side than the second discharge opening 24 in the bottom surface 22*a* of the anode electrode 22. For example, the suction opening 27B is provided in the bottom surface 22*a* of the anode electrode 22 so as to surround the second discharge opening 24 concentrically.

In the fourth modification example, when the plating liquid L1 and the cleaning liquid L2 are supplied into the gap between the wafer W and the anode electrode 22, the suction mechanism is operated to suck the plating liquid L1 and the cleaning liquid L2 present between the first discharge opening 23 and the second discharge opening 24.

Accordingly, the same as in the third modification example, the plating processing can be carried out more stably.

Further, in the fourth modification example, when the plating liquid L1 and the cleaning liquid L2 are supplied into the gap between the wafer W and the anode electrode 22, the cleaning liquid L2 present at the outer side than the second discharge opening 24 is sucked through the suction opening 27B by operating the suction mechanism. Accordingly, it is possible to suppress the cleaning liquid L2 from flowing over to the location other than the region under the anode electrode 22.

Figure 10:
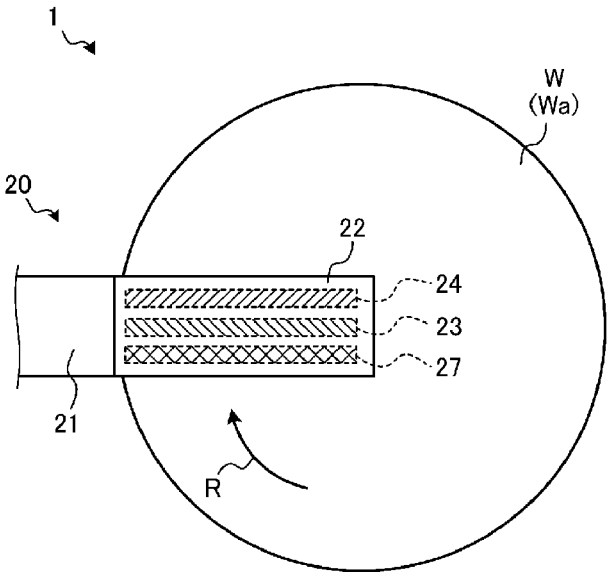
FIG. 10 is a diagram illustrating a configuration of an anode electrode of the plating apparatus according to a fifth modification example of the exemplary embodiment.

FIG. 10 is a diagram showing a configuration of an anode electrode 22 of the plating apparatus 1 according to a fifth modification example of the exemplary embodiment. FIG. 10 is a plan view of the anode electrode 22 seen from above. In the plating apparatus 1 according to the fifth modification example, the plating processing is performed by using the plating unit 20 having a bar nozzle shape.

The plating unit 20 of the fifth modification example has the anode electrode 22 having a rectangular shape extending in a direction substantially perpendicular to a rotation direction R of the wafer W. In this plating unit 20, the first discharge opening 23, the second discharge opening 24, and the suction opening 27 are provided in the bottom surface 22*a* (see FIG. 2) of the anode electrode 22.

Each of the first discharge opening 23, the second discharge opening 24, and the suction opening 27 is disposed along the lengthwise direction of the anode electrode 22. Further, the suction opening 27, the first discharge opening 23 and the second discharge opening 24 are provided in the bottom surface 22*a* of the anode electrode 22 in order from the front side in the rotation direction R.

Now, a plating processing performed by the plating apparatus 1 of the fifth modification example will be explained. First, the controller operates the arm 21 to bring the anode electrode 22 close to the wafer W. At this time, the controller brings the anode electrode 22 close to the wafer W so that the distance between the front surface Wa of the wafer W and the bottom surface 22*a* of the anode electrode 22 becomes a predetermined distance (for example, about 100 μm).

Next, the controller discharges the plating liquid L1 from the first discharge opening 23 into the gap between the wafer W and the anode electrode 22 while rotating the wafer W at the predetermined rotation speed R1 by using the driving mechanism 13 (see FIG. 1).

Further, in parallel with this discharging process of the plating liquid L1, the controller discharges the cleaning liquid L2 from the second discharge opening 24 into the gap between the wafer W and the anode electrode 22, and also sucks the plating liquid L1 from the suction opening 27.

Accordingly, in the fifth modification example, a region in which the plating liquid L1 locally exists can be formed around the first discharge opening 23. In such a state, by operating the voltage applying unit 30 (see FIG. 1), the controller can locally form the plating film on the front surface Wa of the wafer W.

As described so far, in the fifth modification example, by rotating the wafer W while performing the plating processing only on the region under the anode electrode 22, the anode electrode 22 is scanned with respect to the front surface Wa of the wafer W.

Accordingly, the plating processing can be performed while appropriately adjusting the film thickness of the plating film in each region of the wafer W. Therefore, it is possible to form the plating film having high in-surface uniformity on the entire surface of the wafer W.

The plating apparatus 1 according to the exemplary embodiment is equipped with the substrate holder 10, the first electrode (cathode electrode 12*a*), the second electrode (anode electrode 22), and the voltage applying unit 30. The substrate holder 10 holds the substrate (wafer W). The first electrode (cathode electrode 12*a*) is electrically connected to the substrate (wafer W). The second electrode (anode electrode 22) is configured to scan with respect to the front surface Wa of the substrate (wafer W). The voltage applying unit 30 applies a voltage between the first electrode (cathode electrode 12*a*) and the second electrode (anode electrode 22). Further, the first discharge opening 23 configured to discharge the plating liquid L1 and the second discharge opening 24 configured to discharge the cleaning liquid L2 are formed in the bottom surface 22*a* of the second electrode (anode electrode 22). With this configuration, it is possible to form a plating film with high in-surface uniformity on the entire surface of the wafer W.

Moreover, in the plating apparatus 1 according to the exemplary embodiment, the second discharge opening 24 is provided at the outer side of the second electrode (anode electrode 22) than the first discharge opening 23. Accordingly, the plating processing can be performed stably.

Besides, in the plating apparatus 1 according to the exemplary embodiment, the second discharge opening 24 is provided so as to surround the first discharge opening 23. Therefore, the plating processing can be performed more stably.

Further, in the plating apparatus 1 according to the exemplary embodiment, the suction opening 27 (27A, 27B) is provided in the bottom surface 22*a* of the second electrode (anode electrode 22) to suck at least one of the plating liquid L1 and the cleaning liquid L2. Thus, the plating processing can be carried out more stably.

Furthermore, in the plating apparatus 1 according to the exemplary embodiment, the suction opening 27 (27A) is provided between the first discharge opening 23 and the second discharge opening 24. Accordingly, the plating processing can be performed more stably.

Moreover, in the plating apparatus 1 according to the exemplary embodiment, the recess 22*b* is provided in the bottom surface 22*a* of the second electrode (anode electrode 22). Therefore, a uniform plating film can be formed.

In addition, the plating apparatus 1 according to the exemplary embodiment is further equipped with the coil 40 provided neat the first supply path 25 through which the plating liquid L1 is supplied to the first discharge opening 23. Thus, a uniform plating film can be formed.

So far, the exemplary embodiment of the present disclosure has been described. However, it should be noted that the present disclosure is not limited to the above-described exemplary embodiment, and various modifications may be made without departing from the scope of the present disclosure. By way of example, although the above exemplary embodiment has been described for the example where the anode electrode 22 is scanned with respect to the front surface Wa of the wafer W, the cathode electrode may be scanned with respect to the front surface Wa of the wafer W.

Further, in the above-described exemplary embodiment, the plating film is formed by scanning the single anode electrode 22. However, it may be possible to scan a plurality of anode electrodes 22 individually to thereby form plating films respectively. In such a case, a processing time of the plating processing can be shortened.

It should be noted that the above-described exemplary embodiment is illustrative in all aspects and is not anyway limiting. The above-described exemplary embodiment may be omitted, replaced and modified in various ways without departing from the scope and the spirit of claims.

According to the exemplary embodiment, it is possible to form the plating film having high in-surface uniformity on the entire surface of the wafer.

We claim:

1. A plating apparatus, comprising:

a substrate holder configured to hold a substrate;

a first electrode electrically connected to the substrate;

a second electrode configured to scan with respect to a front surface of the substrate;

a voltage applying unit configured to apply a voltage between the first electrode and the second electrode, wherein a first discharge opening configured to discharge a plating liquid and a second discharge opening configured to discharge a cleaning liquid are formed in a bottom surface of the second electrode; and a coil that is disposed coaxially with a first supply path and that surrounds the first supply path through which the plating liquid is supplied to the first discharge opening.

2. The plating apparatus of claim 1, wherein the second discharge opening is provided on the second electrode at a position radially outward of the first discharge opening.

3. The plating apparatus of claim 2, wherein the second discharge opening is provided so as to surround the first discharge opening.

4. The plating apparatus of claim 1, wherein a suction opening configured to suck at least one of the plating liquid or the cleaning liquid is provided in the bottom surface of the second electrode.

5. The plating apparatus of claim 4, wherein the suction opening is provided between the first discharge opening and the second discharge opening.

6. The plating apparatus of claim 1, wherein a recess is provided in the bottom surface of the second electrode.

* * * * *